US008480072B2

(12) United States Patent
Samain et al.

(10) Patent No.: US 8,480,072 B2
(45) Date of Patent: Jul. 9, 2013

(54) FLAT-ARTICLE FEED DEVICE AND A POSTAL SORTING MACHINE

(75) Inventors: Stephane Samain, Chabeuil (FR); Mickael Dauvergne, Mercurol (FR); Stephane Ambroise, Serves (FR)

(73) Assignee: Solystic, Gentilly Cedex (FR)

( * ) Notice: Subject to any disclaimer, the term of this patent is extended or adjusted under 35 U.S.C. 154(b) by 0 days.

(21) Appl. No.: 13/142,117

(22) PCT Filed: Mar. 15, 2011

(86) PCT No.: PCT/FR2011/050517

§ 371 (c)(1),
(2), (4) Date: Jun. 24, 2011

(87) PCT Pub. No.: WO2011/117508

PCT Pub. Date: Sep. 29, 2011

(65) Prior Publication Data

US 2012/0013064 A1 Jan. 19, 2012

(51) Int. Cl.
*B65H 5/22* (2006.01)

(52) U.S. Cl.
USPC ..... 271/3.18; 271/3.21; 271/12; 271/121; 271/149

(58) Field of Classification Search
USPC ..... 271/3.18, 3.2, 3.21, 3.23, 5, 6, 4.05, 271/4.06, 12, 90, 94, 121, 149–151
See application file for complete search history.

(56) References Cited

U.S. PATENT DOCUMENTS

| | | | | |
|---|---|---|---|---|
| 3,126,200 | A | 3/1964 | Rehm | |
| 3,258,262 | A | 6/1966 | Rehm | |
| 4,662,765 | A * | 5/1987 | Kapp et al. | 400/595 |
| 5,429,347 | A * | 7/1995 | Leonard | 271/94 |
| 6,003,857 | A * | 12/1999 | Salomon et al. | 271/122 |
| 6,494,446 | B1 | 12/2002 | Tomiyama et al. | |
| 2007/0216087 | A1 * | 9/2007 | Matsudaira et al. | 271/265.04 |

FOREIGN PATENT DOCUMENTS

| | | |
|---|---|---|
| EP | 0645329 A1 | 3/1995 |
| EP | 0645330 A1 | 3/1995 |
| EP | 0926085 A1 | 6/1999 |
| EP | 1676796 A1 | 7/2006 |
| GB | 949594 | 2/1964 |
| WO | 9405576 A1 | 3/1994 |
| WO | 9518761 A1 | 7/1995 |

* cited by examiner

*Primary Examiner* — Michael McCullough
(74) *Attorney, Agent, or Firm* — Rothwell, Figg, Ernst & Manbeck, P.C.

(57) ABSTRACT

A flat-article feed device comprising a supply magazine in which flat articles are moved in a stack on edge in a first transfer direction, a separator for separating the leading flat article of the stack from the remainder of the stack and for driving it in a second transfer direction that is substantially perpendicular to the first transfer direction, an unstacker that takes a flat article that is being unstacked and brings it in the second transfer direction to the inlet of a conveyor, and a retainer that exerts a retaining force that opposes movement of the flat article towards the conveyor, the unstacker being offset from the separator by a distance not less than the maximum length of a flat article, and the retainer being provided facing the unstacker. A postal sorting machine including such a feed device.

10 Claims, 1 Drawing Sheet

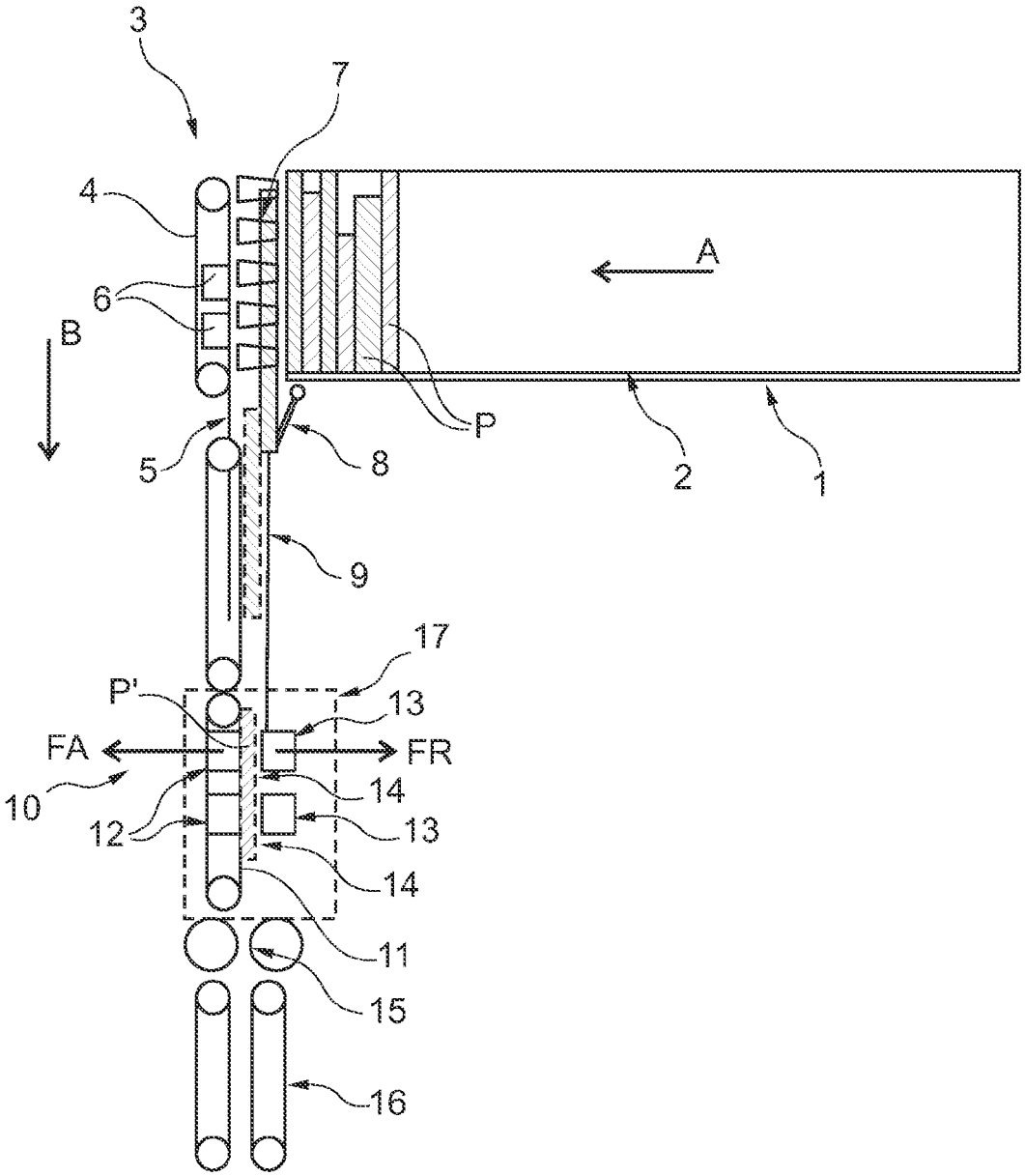
3
7
4
A
6
B
P
5
8
2
1
9
17
P'
13
FA
FR
10
14
12
13
14
11
15
16

FLAT-ARTICLE FEED DEVICE AND A POSTAL SORTING MACHINE

CROSS REFERENCE TO RELATED APPLICATION(S)

This application is a 35 U.S.C. § 371 National Phase Entry Application from PCT/FR2011/050517, filed Mar. 15, 2011, designating the United States and also claims the benefit of French Application No. 1052151, filed Mar. 25, 2010, the disclosures of which are incorporated herein by reference in their entirety.

TECHNICAL FIELD

The invention relates to a flat-article feed device, comprising a supply magazine in which flat articles are moved in a stack on edge in a first transfer direction, separator means for separating the leading flat article of the stack from the remainder of the stack and for driving it in a second transfer direction that is substantially perpendicular to the first transfer direction, unstacker means that take a flat article that is being unstacked and that is separated from the stack and bring it in said second transfer direction to an inlet of a conveyor, and retaining means that exert a retaining force on the flat article being unstacked, which force opposes movement of said article towards the conveyor. The invention also relates to a postal sorting machine including such a feed device.

PRIOR ART

In the meaning of the invention, a "flat article" is, particularly but not exclusively, a mailpiece. Mailpieces that are suitable for being unstacked by means of the feed device of the invention may be of various dimensions, and may also have a variety of mechanical properties, in particular as regards stiffness. The mailpiece may, inter alia, be an ordinary letter, a magazine, an envelope with or without a window, a newspaper, or a catalogue wrapped in a plastics or paper envelope, with or without bellows.

Such a feed device, which is designed particularly for a postal sorting machine, is already known from Patent EP-0 645 330. In that known feed device, the unstacker means bring the flat articles into the conveyor with a predefined spacing or pitch, e.g. a constant pitch between the leading edges of two adjacent flat articles, or indeed a constant spacing between the trailing edge and the leading edge of two adjacent flat articles. In that known feed device, the separator means and the unstacker means are constituted by the same means, and the mailpiece being unstacked is subjected to the pressure from the remainder of the stack of mailpieces present in the supply magazine, and that can be a cause of jams and of multiple feeds. Retaining means referred to as "anti-double-feed" means may be provided so as to avoid such drawbacks to some extent. Such retaining means can only be placed downstream from the unstacker means in said second transfer direction because the unstacker means are placed facing the supply magazine. Unfortunately, downstream from the unstacker means, the mailpieces are already being driven at high speed, i.e. at the conveying speed at which the mailpieces are conveyed in the conveyor, and that makes it difficult to separate mailpieces that are stuck together in multiple-feed bunches, and can give rise to the more fragile of the mailpieces being damaged due to shear forces being exerted on such mailpieces.

U.S. Pat. No. 6,494,446 describes a flat-article feed device including a supply magazine in which flat articles are moved in a stack on edge in a first transfer direction. Separator means separate the leading flat article in the stack from the remainder of the stack and drive it in a second transfer direction that is substantially perpendicular to the first transfer direction, unstacker means associated with continuous suction taking a flat article that has been separated from the stack and bringing it in the second transfer direction to the inlet of a conveyor. That feed device also has means for measuring the thickness of the article after separation, and retaining means that exert a retaining force on the flat article being unstacked, which force opposes movement of the article towards the conveyor, the position of the retaining means being adjustable relative to the unstacker means and servo-controlled as a function of the measured thickness of the flat article. The unstacker means are offset and separate from the separator means, in the second transfer direction, and the retaining means are provided facing the unstacker means.

In addition, U.S. Pat. No. 3,258,262 describes a flat-article feed device in which the separation and unstacking functions are grouped together. That device includes, in particular, a belt through which suction is applied continuously, and which is suitable for driving the flat articles so as to unstack them. Flexible retaining tongues through which suction channels pass are provided facing the suction belt. Those retaining tongues make it possible to retain a second article stacked on a first article, until the suction belt drives the first article and until the corresponding suction zone is unobstructed.

In addition, each of Patents EP 0 660 797 and EP 703 868 discloses a shingler device for shingling, i.e. for staggering in mutually overlapping manner, flat articles between a supply magazine for supplying flat articles disposed in a stack on edge and an unstacker device. That shingler device is mainly made up of conical rollers oriented to apply progressive acceleration to the leading flat articles in the stack, tending to offset them relative to one another in said transfer direction. Such a device makes it possible to reduce the phenomenon of multiple feeds, without however completely eliminating it.

Finally, Patent GB 949 594 describes a flat-article feed device having unstacker means provided with a pivotally mounted suction arm facing the drive belt for the purpose of unstacking the superposed articles. U.S. Pat. No. 3,126,200 describes a flat-article feed device that is substantially similar to the preceding feed device and that has unstacker means provided with a suction arm having a shoe that comes to face the suction belt so as to unstack the superposed articles. Publication EP 1 676 796 describes a flat-article feed device that, in particular, includes an alignment of conical rollers making it possible to move the flat articles after they are unstacked.

However, those devices do not enable phenomena of multiple feeds to be overcome reliably.

SUMMARY OF THE INVENTION

An object of the invention is to propose a flat-article feed device for feeding flat articles, in particular mailpieces, that makes it possible to achieve a further improvement in the quality of unstacking by overcoming phenomena of multiple feeds to an even better extent.

To this end, the invention provides a flat-article feed device, comprising a supply magazine in which flat articles are moved in a stack on edge in a first transfer direction, separator means for separating the leading flat article of the stack from the remainder of the stack and for driving it in a second transfer direction that is substantially perpendicular to the first transfer direction, unstacker means that take a flat article that is being unstacked and that is separated from the stack and bring it in said second transfer direction to an inlet of a conveyor, and retaining means that exert a retaining force on the flat article being unstacked, which force opposes movement of said article towards the conveyor, said flat-article feed device being characterized in that said unstacker means are separate in said second transfer direction from said separator means and offset from said separator means by a distance not less than the maximum length of a flat article in said second transfer direction, and in that said retaining means are provided facing the unstacker means.

The basic idea of the invention is thus to separate the unstacking function from the transfer function by offsetting the unstacking means in itself from the supply magazine in said second transfer direction by a distance sufficiently long to reduce phenomena of multiple feeds. The space left empty between the supply magazine and the unstacker means thus makes it possible to install retaining means facing the upstream end of the unstacker means. The retaining means are therefore adjacent to the supply magazine. At this location of the retaining means, the mailpieces have not yet reached their nominal conveying speed in the conveyor, and they are being accelerated, so that the action of the retaining means does less damage to the mailpieces than in the state of the prior art, and is more effective. In addition, this sufficiently long intermediate zone between the supply magazine and the unstacker means constitutes a corridor in which the unstacked mailpieces are placed one after another in the second transfer direction before they are presented facing the unstacker means. In a particular embodiment of the invention, said unstacker means comprise a perforated belt that is motor-driven so as to move in said second transfer direction, and at least one suction nozzle that is designed to exert on the flat article being unstacked an attraction force oriented substantially perpendicularly to said second transfer direction in order to press it against the motor-driven perforated belt, and the retaining means exert on the flat article being unstacked a retaining force that opposes and that is substantially in alignment with said attraction force. These two mutually "opposing" and "aligned" forces are thus forces acting in opposition one against the other in alignment on either side of the surface of the mailpiece, thereby tending to prevent the mailpiece from being damaged by shear forces.

The retaining means are preferably arranged to exert said retaining force in discontinuous manner, thereby reinforcing the effectiveness of the unstacking.

For the retaining means, it is possible to use friction retaining means, but it is also possible to use suction retaining means. The suction retaining means may be mounted to move on a telescopic arm so as to adapt the retaining force as a function of the thickness of said flat article. The suction nozzle is advantageously controlled selectively in such a manner as to apply suction and not to apply suction in succession.

It is possible to provide a plurality of suction nozzles for the unstacker means that are spaced apart in said second transfer direction, and therefore to provide a plurality of suction nozzles for the retaining means that are associated with respective ones of the suction nozzles of the unstacker means.

In another feature of the invention, the noise generated by the suction nozzles and by the electrically-controlled valves of the unstacker means, and of the retaining means can be considerably attenuated by covering said nozzles and valves with a soundproofing cover. An open space is left empty at the supply magazine in order to enable a machine operator to act at this place in the machine.

In order to separate the mailpieces even better at the outlet of the supply magazine, a shingler member may be provided, e.g. of the type having conical rollers or the like as indicated above, thereby forcing the leading mailpieces in the stack to separate from one another and to be placed in shingled or mutually overlapping staggered manner as they advance in the second transfer direction.

Advantageously, said unstacker means are separate in said second transfer direction from said separator means by a belt conveyor segment suitable for moving said flat articles on edge by friction on one face.

The invention also provides a postal sorting machine including a flat-article feed device as described above.

BRIEF PRESENTATION OF THE DRAWING

An embodiment of the invention is described below in more detail and is shown in the drawing, in which:

FIG. 1 diagrammatically shows a feed device of the invention, seen from above.

DESCRIPTION OF EMBODIMENTS

FIG. 1 is a highly diagrammatic view of a mailpiece feed device of the invention that is designed more particularly for a postal sorting machine.

This feed device includes a supply magazine 1 in which mailpieces P aligned against a jogger edge 2 are stored in a stack on edge with a view to being unstacked. The mailpieces P are shown in FIG. 1 on edge and seen from above.

The floor of the magazine 1 on which the mailpieces rest on edge may be a motor-driven belt that moves the stack of mailpieces in a transfer direction A towards the front of the supply magazine. A movable paddle (not shown) that is movable in the direction A and that may or may not be motor-driven, may also be provided to hold the back of the stack.

At the front of the supply magazine, transfer means 3 are provided and they thus face the front of the stack of mailpieces. The function of the transfer means is to separate the leading mailpiece in the stack from the remainder of the stack, and to move it on edge in a second transfer direction indicated by B in FIG. 1. The direction B is substantially perpendicular to the direction A.

In this example, the transfer means 3 comprise a motor-driven perforated belt 4 that is moved in the direction B along a vertical metal sheet 5 and that co-operates with one or more suction nozzles 6 that exert an attraction force through the belt 4, tending to press the leading mailpiece in the stack against the belt 4. The combined action of the belt 4 and of the nozzles 6 separates said leading mailpiece in the stack from the remainder of the stack, and moves it in the direction B at a low speed, of about 0.5 meters per second (m/s).

With the transfer means 3, FIG. 1 shows a series of conical rollers 7 placed in line in front of the supply magazine 1, and serving, in association with the action of a moving flap 8, to perform shingling, i.e. to place a plurality of mailpieces situated at the front of the stack in a mutually overlapping staggered position. The conical rollers 7 are oriented to apply to the mailpieces at the front of the stack a progressive tangential speed in the direction A, thereby causing the leading mailpiece in the stack that is separated from the stack to find itself ahead in the direction B relative to the mailpiece that succeeds it in the stack, and so on for the successive mailpieces being unstacked. The conical rollers 7 may be placed in line in a setback or in a "drop" (not shown) contributing to better separation (by an aeration effect) of said mailpieces at the front of the stack.

The moving flap 8 is disposed adjacent to the feed magazine and downstream therefrom in the direction B. It is hinged pivotally and co-operates with the vertical metal sheet 5 that extends in the direction B to define a sort of feed cone that is closed to a greater or lesser extent, allowing a larger number or a smaller number of mailpieces through at the same time. At rest, the flap 8 closes the feed cone under the action of a return spring (not shown). The mailpieces moved under the action of the belt 4 thus come to push the flap 8 in order to go beyond the supply cone, thereby also tending, by a rolling effect, to separate any mailpieces that are superposed (multiple feeds). In practice, the maximum opening of the feed cone defined between the flap 8 and the metal sheet 5 can be as large as 20 millimeters (mm) for a maximum mailpiece thickness of about 10 mm. A sensor may be provided in order to detect the angular position of the moving flap and in order to switch on or switch off the motor drive for the belt 4 when the flap is in or leaves its maximum opening position.

As shown in FIG. 1, downstream from the feed cone, the mailpieces are taken by a belt conveyor segment 9 that moves the mailpieces on edge by friction on one face of each mailpiece. The length of this belt conveyor segment 9 is sufficiently long and not less than the maximum length of a mailpiece. In this conveyor segment 9, the mailpieces are placed approximately in uniformly staggered and mutually overlapping manner relative to one another (i.e. in a shingled configuration) and they move in the direction B towards the unstacker device 10, it being possible for the pitch between the leading edges of two consecutive mailpieces to be approximately in the range 5 mm to 30 mm.

In accordance with the invention, the unstacker device 10 proper is placed downstream from the conveyor segment 9 in the direction B. The unstacker device 10 is thus offset in the direction B from the transfer means 3 and thus from the supply magazine and is separate from said transfer means and from said supply magazine by the conveyor segment 9. In this example, the unstacker 10 comprises a perforated belt 11 moved at a high speed of about 2.5 m/s and that co-operates with two suction nozzles 12 powered via solenoid valves. As can be seen in FIG. 1, the two suction nozzles 12 are aligned in the direction B and face respective ones of two other suction nozzles 13 that are part of a retaining device preventing the phenomenon of multiple feeds. More particularly, the two suction nozzles 12 exert on one face of a mailpiece P' facing the belt 11 an attraction force FA oriented perpendicularly to the direction B in order to press it against the belt 11. The two other suction nozzles 13 powered via solenoid valves exert on the other face of the mailpiece another attraction force FR oriented perpendicularly to the direction B but in the opposite direction to the force exerted by the nozzles 12, the force exerted by the nozzles 13 tending to oppose movement of the mailpiece in the direction B. The attraction force exerted by the nozzles 13 is less than the force exerted by the nozzles 12, as is known from the state of the art.

A passage sensor 14 is placed between the two nozzles 12 in the direction B, and another passage sensor is placed downstream from the nozzle 12 that is further downstream in the direction B, so as to control the solenoid valves of the nozzles 12 and 13. In practice, when the passage of the mailpiece P' entering the unstacker 10 is detected by a first sensor 14, the opposing nozzles 12 and 13 that are further downstream in the direction B are actuated so that they apply suction, thereby causing them to exert at the same time the two opposite forces FA and FR that are in alignment. If the mailpiece P' in the unstacker is in a double feed, e.g. with another mailpiece, the mailpiece P' that is pressed against the belt 11 continues to move in the direction B while the other mailpiece that is superposed is retained by the nozzle 13. When passage of the mailpiece P' is detected by the other sensor 14, the opposing nozzles 12 and 13 that are further downstream in the direction B are actuated while the suction of the nozzle 12 further upstream is stopped. The mailpiece P' is thus moved further at high speed in the direction B so as to be brought to the inlet 15 of a series conveyor 16 in which the mailpieces are moved at high speed on edge with a constant pitch between leading edges, for example. In this example, the inlet 15 of the conveyor is a nip point constituted by two deformable wheels disposed in opposing manner. When the mailpiece P' has left the unstacker, which can be detected by another passage sensor, the nozzle 12 that is further upstream is actuated again so as to take the other mailpiece that was in a double feed with the mailpiece P', and the process of actuating the nozzles 12 and 13 is repeated as indicated above for the successive mailpieces.

The manner in which the nozzles 13 are disposed relative to the nozzles 12 in accordance with the invention makes separation of mailpieces in multiple feeds more effective because the retaining means act as of the start of acceleration to high speed of the mailpieces being unstacked. In addition, by means of the nozzles 12 and the nozzles 13 being disposed face to face, it is possible to avoid the effects of shearing on the mailpieces, which effects cause jams.

In accordance with the invention, it is possible to make provision to cover the unstacker members 10 with a soundproofing cover 17, and more particularly to put such a cover over the noisy members such as the nozzles 12 with their solenoid valves and also the nozzles 13 with their solenoid valves so as to impart additional operating comfort to the feed device.

The feed device of the invention may be used for flat articles other than mailpieces, e.g. for bank checks and banknotes.

The invention claimed is:

1. A flat-article feed device, said device comprising:

a supply magazine on which flat articles are moved in a stack on edge in a first transfer direction, separator means for separating a leading flat article of the stack from a remainder of the stack and for driving the leading flat article in a second transfer direction that is substantially perpendicular to the first transfer direction, unstacker means for taking a flat article that is being unstacked and that is separated from the stack and bringing the flat article in said second transfer direction to an inlet of a conveyor, and retaining means for exerting a retaining force perpendicular to said second transfer direction on the flat article being unstacked, which force opposes movement of said article towards the conveyor in said second transfer direction, said article being moved in said second transfer direction, wherein said unstacker means are separate in said second transfer direction from said separator means by a belt conveyor segment suitable for moving said flat articles on edge by friction on one face and offset from said separator means by a distance not less than the maximum length of a flat article in said second transfer direction, and wherein said retaining means is provided facing the unstacker means.

2. A device according to claim 1, wherein said unstacker means comprise a perforated belt that is motor-driven so as to move in said second transfer direction, and at least one suction nozzle that is designed to exert on the flat article being unstacked an attraction force oriented substantially perpendicularly to said second transfer direction in order to press it against the motor-driven perforated belt, and wherein the retaining means exerts on the flat article being unstacked a retaining force that opposes and that is substantially in alignment with said attraction force.

3. A device according to claim 2, wherein said retaining means is arranged to exert said retaining force in a discontinuous manner.

4. A device according to claim 3, wherein said suction nozzle is controlled selectively in such a manner as to apply suction and not to apply suction in succession.

5. A device according to claim 2, wherein said retaining means are suction retaining means and comprise at least one suction nozzle.

6. A device according to claim 2, wherein said retaining means is mounted to move so as to adapt said retaining force as a function of the thickness of said flat article.

7. A device according to claim 2, wherein said retaining means includes friction retaining means.

8. A device according to claim 1, further comprising a sound proofing cover covering said unstacker means and said retaining means.

9. A device according to claim 1, wherein said separator means is arranged to position a plurality of adjacent flat articles in shingled or mutually overlapping staggered manner in said second transfer direction.

10. A postal sorting machine, wherein it includes a flat-article feed device according to claim 1.

* * * * *